US005388411A

United States Patent [19]

McKeever et al.

[11] Patent Number: 5,388,411

[45] Date of Patent: Feb. 14, 1995

[54] METHOD OF CONTROLLING SEAL STEAM SOURCE IN A COMBINED STEAM AND GAS TURBINE SYSTEM

[75] Inventors: Craig W. McKeever, Schenectady; Daniel T. Lee, Clifton Park, both of N.Y.

[73] Assignee: General Electric Company, Schenectady, N.Y.

[21] Appl. No.: 943,233

[22] Filed: Sep. 11, 1992

[51] Int. Cl.[6] ..... F01K 13/02

[52] U.S. Cl. ..... 60/646; 60/657

[58] Field of Search ..... 60/657, 646, 677, 656

[56] References Cited

U.S. PATENT DOCUMENTS

| | | | |
|---|---|---|---|
| 3,935,710 | 2/1976 | Dickinson | 60/657 |
| 4,282,708 | 8/1981 | Kuribayashi et al. | 60/39.02 |
| 4,437,313 | 3/1984 | Taber et al. | 60/665 |
| 4,519,207 | 5/1985 | Okabe et al. | 60/39.182 |
| 4,561,254 | 12/1985 | Martens et al. | 60/660 |
| 4,589,256 | 5/1986 | Akiba et al. | 60/657 |
| 4,793,141 | 12/1988 | Yanai et al. | 60/657 |
| 5,029,443 | 7/1991 | Hauser | 60/656 |
| 5,042,246 | 8/1991 | Moore et al. | 60/39.03 |

OTHER PUBLICATIONS

"GE Combined-Cycle Product Line and Performance", Chase et al., GE Power Generation, GE Turbine Reference Library.

*Primary Examiner*—Ira S. Lazarus
*Assistant Examiner*—L. Heyman
*Attorney, Agent, or Firm*—Nixon & Vanderhye

[57] ABSTRACT

A method of operating a combined gas and steam turbine cycle system including a steam turbine provided with steam from at least one heat recovery steam generator having a high pressure section and a low pressure section, wherein the steam turbine includes high pressure seals and low pressure seals, includes the steps of:

a) when the steam turbine is operating at a load below a self-sealing load, supplying steam at a controlled, predetermined pressure to the high and low pressure seals from the high pressure section of the heat recovery steam generator; and b) after steam from the lower pressure section of the heat recovery stem generator exceeds the predetermined pressure, supplying the high and low pressure seals with steam from the lower pressure section of the heat recovery steam generator at a pressure higher than the predetermined pressure, and c) supplying steam from the high pressure section of the heat recovery steam generator whenever a turbine metal inlet temperature exceeds a predetermined reference temperature and turbine load is less than a predetermined reference load.

19 Claims, 1 Drawing Sheet

METHOD OF CONTROLLING SEAL STEAM SOURCE IN A COMBINED STEAM AND GAS TURBINE SYSTEM

TECHNICAL FIELD

This invention relates to steam turbine operating procedures in combined cycle systems which combine gas turbines, steam turbines, heat recovery steam generators and controls for the production of electric power. Specifically, the invention relates to a method for providing steam at suitable temperatures to the steam turbine seals when the steam turbine is operating at a load below its self-sealing point.

BACKGROUND PRIOR ART

Currently available combined cycle systems of the assignee of this invention include single and multi-shaft configurations. Single shaft configurations may include one gas turbine, one steam turbine, one generator and one heat recovery steam generator (HRSG). The gas turbine and steam turbine are coupled to the single generator in a tandem arrangement on a single shaft. Multi-shaft systems, on the other hand, may have one or more gas turbine-generators and HRSG's that supply steam through a common steam header to a single steam turbine generator. In either case, steam is generated in one or more HRSG's for delivery to the condensing steam turbine.

It is well known that when a steam turbine is operating at a load below its self-sealing point, steam from an external supply (i.e., make-up steam) must be provided to the seal steam header to maintain the turbine seals until self-sealing point is reached.

At the same time, it is important that the external steam source temperature be within certain limits, depending on the inlet metal temperature of the turbine, and the load on the machine. Operation within such limits is essential to limit differential expansion in the machine, and to avoid possible thermal fatigue and other material limitations in the turbine.

Conventional techniques for supplying seal steam include:

a) Using throttle steam and attemporating (cooling) when it is too hot to meet the requirements of the steam turbine;

b) Using throttle steam and operating the steam turbine for minimal time below the self-sealing point to limit the amount of time that the turbine seals are subject to high temperature steam;

c) Using an intermediate pressure (IP) or low pressure (LP) header with lower steam temperatures than the throttle source. This source may be too cool, however, if the turbine is hot and operating at low load. Under this condition, the operator must limit operation at low loads to as small a time as possible; and d) Using an auxiliary boiler which is designed to provide sealing steam at an acceptable temperature for all turbine conditions.

SUMMARY OF THE INVENTION

The object of this invention is to allow the use of existing steam supplies from a multi-pressure combined cycle heat recovery steam generator plant (i.e., an HRSG with high pressure (HP), intermediate pressure (IP) and/or low pressure (LP) sections) in combination to provide acceptable steam seal source temperature for all turbine conditions. Thus, the invention eliminates the need for attemporation, and/or the need for an auxiliary boiler. For systems that use neither attemporation nor the auxiliary boiler, this invention eliminates certain turbine situations where the operator must be aware to minimize the time spent at particular load points.

In an exemplary embodiment of the invention, a unique valve, piping and control arrangement is provided for supplying so-called make-up steam to the high and low pressure seals of the steam turbine. Generally, a high pressure steam header from one or more HRSG's feeds high pressure steam to the high pressure section of the steam turbine, while an intermediate and/or low pressure steam header from the same HRSG's feeds intermediate and/or low pressure steam to the low pressure section of the steam turbine. While the HRSG's typically have HP, IP and LP sections, and while the IP or LP sections may be used in this invention in combination with the HP section, reference will be made herein simply (for convenience) to an HP and an LP section with the understanding that LP embraces both IP and LP sections as make-up steam sources.

In the present invention, a bridge conduit connects the high and low pressure headers at opposite ends thereof, while a seal steam header connects to the bridge conduit (intermediate the ends thereof), and communicates directly with the high and low pressure seals of the steam turbine.

The high pressure section of the bridge conduit, i.e., that part of the conduit between the high pressure header and the junction with the seal steam header, is provided with an HP pressure control valve, and HP shut-off valve and a first check valve, consecutively, in a direction from the high pressure header. The low pressure section of the conduit, i.e., that part of the conduit between the low pressure header and the junction with the seal steam header, is provided with an LP shut-off valve and a second check valve, consecutively, in a direction from the low pressure header.

The HP pressure control valve is controlled to maintain a given constant pressure in the high pressure section of the bridge conduit and, typically, this means reducing the pressure below high pressure output from the HP section of the one or more HRSG's. The HP shut-off valve is controlled to open when the pressure in the high pressure steam header is high enough to supply adequate steam to the seal steam header. The second check valve is automatically held shut until the pressure in the low pressure header exceeds that determined by the setting of the HP pressure control valve. Thus, the above described valve arrangement automatically uses HP steam until sufficient steam is available from the low pressure steam header. Thus, during start-up, for example, the LP steam pressure will lag the HP steam pressure as pressure builds in each line. The pressure set by the HP pressure control valve is at a value high enough to supply ample steam to the seal steam header, and the second check valve is automatically closed (with the first check valve open) until the LP header pressure is high enough to overcome the predetermined pressure set by the HP pressure control valve. Since the HP pressure control valve maintains a pressure which is less than the pressure in the low pressure section of the bridge conduit, opening of the LP shut-off valve will supply steam to the seal steam header from the low pressure steam header as the high pressure steam header will be shut off by automatic closure of the first check valve. On the other hand, when the LP shut-off valve is closed, the first check valve automatically opens so that high pressure steam (as controlled by the HP pressure control valve) will be supplied to the seal steam header.

The LP shut-off valve is controlled by a logic circuit to close if the steam turbine inlet metal temperature exceeds a reference temperature and if the steam turbine load is less than a reference load. Otherwise, the LP shut-off valve remains open. Specifically, the logic circuit looks at the turbine condition and obtains appropriate steam seal source temperature by the simple on/off operation of the LP shut-off valve.

Thus, in its broadest aspects, the present invention provides a method of operating a steam turbine at a load below a self-sealing load such that make-up steam must be supplied to high and low pressure seals of the steam turbine, wherein steam for the turbine is supplied from a heat recovery steam generator, comprising the steps of:

a) supplying steam from high or low pressure sections of the heat recovery steam generator to high and low pressure seals of the steam turbine via a seal steam header; and b) controlling which of the high and low pressure sections of the heat recovery steam generator supplies steam to the high and low pressure seals as a function of pressure in a low pressure header connected to the low pressure section of the heat recovery steam generator, percent turbine load and turbine inlet metal temperature.

Additional objects and advantages of the invention will become apparent from the detailed description which follows.

BRIEF DESCRIPTION OF THE DRAWINGS

The single FIGURE illustrates a valve and piping diagram for supplying steam to the high and low pressure seals of a steam turbine in accordance with an exemplary embodiment of the invention.

BEST MODE FOR CARRYING OUT THE INVENTION

Figure 1:
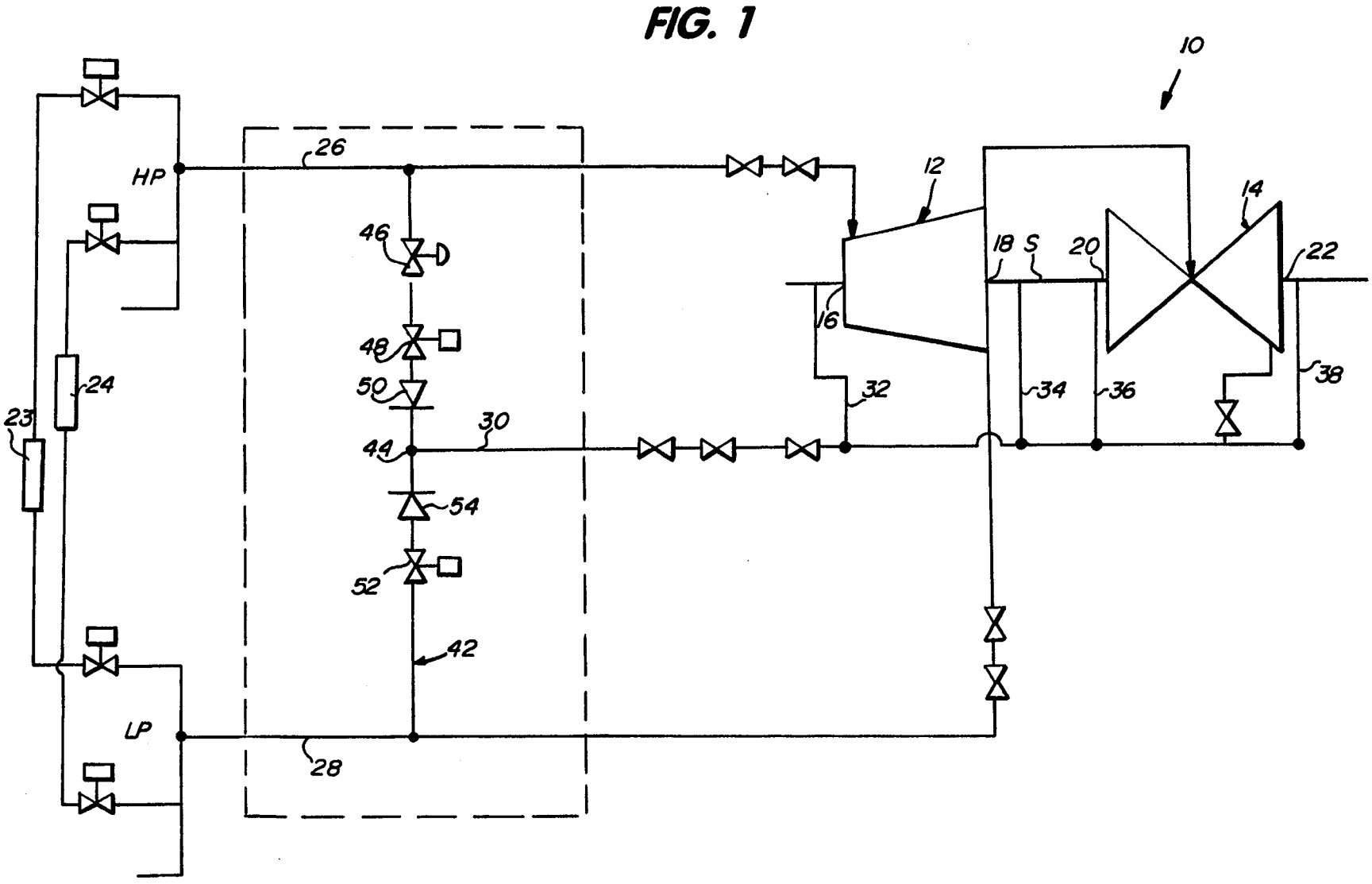

With reference to the FIGURE, a steam turbine 10 is shown which includes a high pressure section 12, a low pressure section 14. Steam turbine 10 also includes associated high pressure seals 16 and 18, and low pressure seals generally indicated at 20 and 22, surrounding the rotor or shaft S.

Heat recovery steam generators (HRSG's) 23 and 24 typically provide steam to the steam turbine via a high pressure header 26 and a low pressure header 28. As explained above, the low pressure header 28 may in reality supply steam from either the low pressure (LP) or intermediate pressure (IP) sections of the one or more HRSG's, but for convenience sake, the header 28 will be referred to herein as a low pressure header. Accordingly, the high pressure header 26 supplies steam from the high pressure sections of the HRSG's 23 and 24 to the high pressure section 12 of turbine 10, while the low pressure header 28 supplies steam from the intermediate or low pressure sections of the HRSG's 22 and 24 to the low pressure section 14 of the steam turbine 10.

Seal steam is supplied to the seals 16, 18, 20 and 22 by means of a seal steam header 30 and branch conduit 32, 34, 36 and 38. The high presstire header 26 and low pressure header 28 are connected by means of bridge conduit 42 with an intermediate junction at 44 where the seal steam header 30 is joined to the bridge conduit 42. In the high pressure section of conduit 42, i.e., between the high pressure header 26 and junction 44, there are located a high pressure, pressure control valve (HP PCV) 46, a high pressure shut-off valve (HP SOV) 48, and a first check valve 50. At the same time, in the low pressure section of conduit 42, i.e., between the low pressure header 28 and junction 44, are located a low pressure shut-off valve (LP SOV) 52 and a second check valve 54.

Other valves illustrated in the diagram (but not numbered) are conventional in location and operation and need not be described here.

The operation of the system in accordance with an exemplary embodiment of the invention will now be described. The operating procedure in accordance with this invention is based on a thorough understanding of the operating characteristics of the gas turbine (not shown) HRSG's 23 and 24 (there may be any number of HRSG's in the system), and the manner in which steam pressures and temperatures vary with time during turbine operation at low load, e.g., at start-up.

For purposes of the description provided below, the steam pressures at various locations in the FIGURE may be characterized as follows:

$P_1$=steam pressure in the high pressure header 26;

$P_2$=steam pressure in the high pressure section of the bridge conduit 42, as controlled by (and therefore downstream of) the HP PCV 46;

$P_3$=steam pressure in the seal steam header 30; and $P_4$=steam pressure in the low pressure header 28 and in the low pressure section of bridge conduit 42.

Initially, there is no LP steam, so that HP steam is used to supply the seal steam via high pressure header 26, bridge conduit 42 and seal steam header 30. The HP PCV 46 maintains the steam supplied (at a level $P_1$) from the HP section of HRSG's 22 and 24 at a level $P_2$, which for purposes of this example, may be 50 p.s.i. During this period, the first check valve 50 is open and the second check valve 54 is closed to block off the low pressure section of the bridge conduit 42, so that no low pressure steam from low pressure steam header 28 is supplied to the seal steam header 30.

When the LP steam in low pressure header 28 rises to a level which exceeds 50 p.s.i., the second check valve 54 opens and the first check valve 50 closes to block the high pressure steam from header 26 from entering the seal steam header 30, and the seal steam will then be supplied from the low pressure steam header 28 via the low pressure section of bridge conduit 42. The low pressure steam will rise to a pressure $P_4$ (in this example, about 65 p.s.i. ) which will, as noted above, cause the first check valve 50 to close.

Thus, at the beginning of the cycle, $P_3$ will be at 50 p.s.i. while the seal steam is supplied by high pressure header 26, but as the LP steam takes over, $P_3$ will rise to 65 p.s.i.

The control of LP SOV 52 comes into play when the turbine is below its self-sealing load. The LP SOV 52 is controlled by a logic circuit as follows:

the valve is cloned if the turbine inlet metal temperature exceeds a $T_{ref}$ AND the steam turbine load is below an $L_{ref}$; if the load is above $L_{ref}$, the LP SOV 52 remains open. In this example, $T_{ref}$=700° F. and $L_{ref}$=25%.

The reference load $L_{ref}$ refers to the load above which the HP seals 16 and 18 are self-sealing. However, make-up steam is still required to supply the LP seals 20 and 22 between the load $L_{ref}$ and the self-seal load of the turbine.

The reference temperature $T_{ref}$ refers to the temperature of the turbine inlet metal above which the hotter steam from the high pressure header 26 is more desirable for the HP seals than the low pressure header 28.

In other words, the logic circuit looks at the turbine condition and obtains appropriate steam seal source temperature by the simple on/off operation of only one valve, the LP SOV 52. Since $P_2$ is set less than $P_4$, opening of the LP SOV 52 [(at any turbine inlet metal temperature and a turbine load greater than 25%) or (when the turbine metal temperature is less than 700° F. at any turbine load)] will supply steam from the low pressure steam header 28 to the seal steam header 30 and the steam from the high pressure steam header 26 will be shut off by automatic closure of the first check valve 50. When the LP SOV 52 is closed (when the turbine inlet metal temperature exceeds 700° F. and the turbine load is less than 25%), the first check valve 50 automatically opens and the HP steam from header 26 is supplied to the seal steam header 30.

An important feature here is that the valve arrangement and specifically selected pressure setting of the HP SOV automatically supplies HP steam until sufficient steam is available from the LP header. During start-up, for example, the LP steam will lag the HP steam as pressure builds in each line. Since $P_2$ is set at a value high enough to supply ample steam to the steam seal header 30, the first check check valve 50 remains open (and the second check valve 54 automatically closes) until $P_4$ in the low pressure steam header 28 is high enough to overcome $P_2$, thereby opening check valve 52 and closing check valve 50. Steam is then supplied to the seals from the low pressure header 28, but subject to the operation of the LP SOV 52 as described by the logic above.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A method of operating a steam turbine at a load below a self-sealing load such that make-up steam must be supplied to a plurality of high and low pressure seals of the steam turbine, wherein the steam turbine includes a metal inlet, and wherein steam for the steam turbine is supplied from a heat recovery steam generator having high and low pressure sections via high and low pressure headers, respectively, the method comprising the steps of:

a) supplying steam from the high or low pressure sections of the heat recovery steam generator to said plurality of high and low pressure seals of the steam turbine via a seal steam header; and b) controlling which of the high and low pressure sections of the heat recovery steam generator supplies said steam to said plurality of high and low pressure seals as a function of pressure in said low pressure header which is connected to the low pressure section of the heat recovery steam generator, percent turbine load, and temperature of said metal inlet of said turbine.

2. The method of claim 1 wherein steam at a pressure $P_1$ in a high pressure header connected to the high pressure section of the heat recovery steam generator is supplied to said plurality of high and low pressure seals at a controlled pressure level $P_2$, and when a steam pressure $P_4$ in said low pressure header connected to said low pressure section of the heat recovery steam generator exceeds $P_2$, then steam from the low pressure section of the heat recovery steam generator is supplied to said plurality of high and low pressure seals at a steam pressure $P_3$ which, initially, is substantially equal to $P_2$ and which increases to a pressure greater than $P_2$.

3. The method of claim 1 and wherein a low pressure shut-off valve shuts off steam from said low pressure section of the heat recovery steam generator when steam turbine inlet metal temperature exceeds a predetermined reference temperature and percent turbine load is less than a predetermined reference load.

4. The method of claim 2 and wherein a low pressure shut-off valve shuts off said steam from said low pressure section of the heat recovery steam generator when said temperature of said metal inlet of said turbine exceeds a predetermined reference temperature, and percent turbine load is less than a predetermined reference load.

5. The method of claim 3 wherein said reference temperature is about 700° and said reference load is about 25%.

6. The method of claim 4 wherein said reference temperature is about 700° and said reference load is about 25%.

7. The method of claim 2 wherein $P_2$ is about 50 p.s.i.

8. The method of claim 4 wherein $P_2$ is about 50 p.s.i.

9. The method of claim 7 wherein $P_4$ is about 65 p.s.i.

10. The method of claim 8 wherein $P_4$ is about 65 p.s.i.

11. In a method of operating a combined gas and steam turbine cycle system including a steam turbine provided with steam from at least one heat recovery steam generator having a high pressure section and a low pressure section, wherein the steam turbine includes high pressure seals and low pressure seals, the steps of:

a) when the steam turbine is operating at a load below a self-sealing load, supplying steam at a controlled, predetermined pressure to the high and low pressure seals from the high pressure section of the heat recovery steam generator; and b) after steam from the low pressure section of the heat recovery stem generator exceeds said predetermined pressure, supplying the high and low pressure seals with steam from the low pressure section of the heat recovery steam generator at a pressure higher than said predetermined pressure.

12. The method of claim 11 wherein said predetermined pressure is less than the pressure of the steam exiting the high pressure section of the heat recovery steam generator.

13. The method of claim 11 wherein said predetermined pressure is 50 p.s.i.

14. The method of claim 13 wherein said higher pressure is 65 p.s.i.

15. The method of claim 11 wherein said heat recovery steam generator supplies high pressure steam from said high pressure section of the heat recovery steam generator to a high pressure section of the steam turbine via a high pressure header, and low pressure steam from said low pressure section of the heat recovery steam generator via a low pressure header.

16. The method of claim 15 wherein a bridge conduit connects the high and low pressure headers, and a seal steam header extends between said bridge conduit and said high and low pressure seals.

17. The method of claim 16 wherein said bridge conduit includes a high pressure-pressure control valve, a high pressure shut-off valve and a first check valve in a portion of said bridge conduit extending between said high pressure header and a junction with said seal steam header.

18. The method of claim 17 wherein said bridge conduit includes a low pressure shut-off valve and a second check valve in a portion of said bridge conduit extending between said low pressure header and said junction with said seal steam header.

19. A method of operating a combined gas and steam turbine cycle system including a steam turbine provided with steam from at least one heat recovery steam generator having a high pressure section and low pressure section, and wherein condensed steam from said steam turbine is heated by exhaust gas from said gas turbine, and further wherein the steam turbine includes high pressure seals and low pressure seals, the method comprising the steps of:

a) when the steam turbine is operating at a load below a self-sealing load, supplying steam at a controlled, predetermined pressure to said high pressure seals and said low pressure seals from the high pressure section of the heat recovery steam generator; and b) after steam from the low pressure section of the heat recovery steam generator exceeds the predetermined pressure, supplying said high pressure seals and low pressure seals with steam from the low pressure section of the heat recovery steam generator at a pressure higher than the predetermined pressure; and thereafter c) supplying steam from the high pressure section of the heat recovery steam generator whenever a turbine metal inlet temperature exceeds a reference temperature and turbine loading is less than a predetermined reference load.

* * * * *